United States Patent [19]

Kunczynski

[11] Patent Number: 4,658,733

[45] Date of Patent: Apr. 21, 1987

[54] AERIAL TRAMWAY GRIP ASSEMBLY

[76] Inventor: Jan K. Kunczynski, 2400 Arrowhead Dr., Carson City, Nev. 89701

[21] Appl. No.: 766,710

[22] Filed: Aug. 19, 1985

[51] Int. Cl.[4] ..... B61B 12/12

[52] U.S. Cl. ..... 104/208; 104/209; 104/211; 104/215; 104/216

[58] Field of Search ..... 104/208, 209, 211, 212, 104/214, 216, 217, 222, 224, 225, 202, 215

[56] References Cited

U.S. PATENT DOCUMENTS

| | | | |
|---|---|---|---|
| 387,992 | 8/1888 | Pendleton | 104/215 |
| 3,037,464 | 6/1962 | Penney et al. | 104/209 |
| 3,827,372 | 8/1974 | Laurent | 104/209 |
| 3,871,303 | 3/1975 | Woodung | 104/209 X |
| 4,364,314 | 12/1982 | Gaudet | 104/225 |

FOREIGN PATENT DOCUMENTS

| | | | |
|---|---|---|---|
| 0308544 | 10/1919 | Fed. Rep. of Germany | 104/208 |
| 0542702 | 1/1932 | Fed. Rep. of Germany . | |

*Primary Examiner*—David A. Scherbel
*Assistant Examiner*—Scott H. Werny
*Attorney, Agent, or Firm*—Manfred M. Warren; Robert B. Chickering; Glen R. Grunewald

[57] ABSTRACT

A haul rope grip assembly for an aerial tramway is disclosed which is suitable for both detachable and permanent gripping of the tramway haul rope. The assembly includes a gripping head having a pair of relatively spaced apart converging haul rope gripping surfaces oriented for gravity biasing of the surfaces into wedging engagement with the haul rope under loading of the grip. Additionally, the assembly includes a jaw positioned proximate the surfaces and formed to apply supplemental force to the haul rope in a direction tending to further wedge the haul rope between the gripping surfaces. The jaws are also formed to unwedge the haul rope upon movement from a closed to an open position. In the detachable grip assembly, a pair of independently movable jaws pivotally mounted and actuated by levers are biased closed with leaf springs that are spaced apart to allow for a hold down sheave. In the permanent grip assembly, the wedging surfaces are further oriented to increase wedging as the grip passes around a horizontal bull wheel. The method of securing a grip assembly to an aerial tramway haul rope is also disclosed.

7 Claims, 6 Drawing Figures

AERIAL TRAMWAY GRIP ASSEMBLY

BACKGROUND OF THE INVENTION

The present invention relates, in general, to aerial tramways, and more particularly, relates to the detachable and permanent grip assemblies used to secure the passenger conveying units of an aerial tramway to the haul rope.

Two general categories of aerial tramway haul rope grip assemblies are in widespread use, namely, detachable grip assemblies and permanently affixed grip assemblies. Detachable grip assemblies are employed in aerial tramways such as gondolas, some chairlifts and some trams. Detachable grip assemblies are regularly removed from the tramway haul rope, usually to permit loading and unloading of the passenger carrier units at a tramway terminal or station. The permanently affixed grip assemblies are used in aerial tramways such as chairlifts, ski lifts, Poma lifts and trams. While such "permanent" grips can be removed from the haul rope, they seldom are removed unless they are undergoing maintenance or repair. As used herein, the expression "aerial tramway" shall be understood to include any haul rope based conveying system of the type having a plurality of load carrying units secured to a haul rope to enable the units to be conveyed over or along a course.

The performance criteria for aerial tramway grip assemblies typically have been established by industry regulating bodies or the laws of various countries. In the United States, for example, the current grip performance criteria is that the gripping force generated by the grip assembly must be at least three times that required to prevent slippage of the grip along the rope (a safety factor of 3), and the grip must produce a three percent reduction in rope area at the grip. Since rope manufacturers typically manufacture haul rope to a nominal diameter plus 6% minus 3% along the rope length, grip assemblies must be capable of meeting these performance criteria notwithstanding variation of the rope diameter along the length of the rope.

Prior art aerial tramway grip assemblies have been formed with at least one movable clamping jaw which cooperates with a second fixed or movable jaw to grip the haul rope therebetween. Some systems have further included opposed wedging surfaces in the clamping jaws, but such wedging surfaces have been generally horizontally oriented which results in the weight of the passenger carrier unit tending to pull the haul rope out of the gripping jaws. The prior art wedging jaw-based systems, therefore, have not been fail-safe, and they have attained the very substantial rope gripping forces required almost entirely as a result of spring or fastener generated forces urging the two jaws together.

In recent years there also has been a trend in the aerial tramway industry to increase the uphill carrying capacity of tramways. This, in turn, has resulted in an increase in prime mover horsepower and a corresponding increase in haul rope diameter. Carrier units also have increased in capacity and accordingly weight. Thus, the rope gripping forces are now quite substantial, and the problems attendent to detaching and attaching the carrier units from the rope are substantial. A gondola system may require, for example, 5000–6000 pounds of force to open the detachable grip assembly.

To solve the substantial gripping problems which have developed over the years in aerial tramways, detachable grip assemblies have become relatively complex. Many grips have over 100 parts and require involved support structures at the tramway terminals to operate the grips. Moreover, the grip release levers often pose problems in terms of supporting the haul rope on towers intermediate the stations, namely, the release levers can interfere with attempts to hold down the haul rope at towers at which hold down sheaves would normally be required.

OBJECTS AND SUMMARY OF THE INVENTION

A. Objects of the Invention

Accordingly, it is an object of the present invention to provide a haul rope grip assembly for an aerial tramway or the like which is adaptable to both detachable and permanent aerial tramway rope gripping applications.

It is a further object of the present invention to provide a haul rope grip assembly and method which greatly enhances the ease of mounting of the grip to the haul rope, whether the mounting is permanent or detachable.

Another object of the present invention is to provide a method for securing a grip assembly to the haul rope of an aerial tramway in which the gripping force is generated in part by the load of the passenger carrier unit on the grip assembly.

Another object of the present invention is to provide a haul rope grip assembly which is fail-safe.

A further object of the present invention is to provide a haul rope grip assembly for an aerial tramway and the like having a minimum number of parts and an attendant economy of manufacture and installation.

Still a further object of the present invention is to provide a haul rope grip assembly and method suitable for use in detachable grip assembly applications and constructed so as to minimize the forces required for release and gripping of the haul rope.

Another object of the present invention is to provide a a haul rope grip assembly for a detachable grip which can be used with hold down sheaves.

Another object of the present invention is to provide a haul rope grip assembly for permanent mounting to the haul rope in which the passage of the grip assembly over horizontal bull wheels tends to enhance gripping of the haul rope.

Still another object of the present invention is to provide a haul rope grip assembly which is durable, adaptable to a wide range of applications, and built to be relatively maintenance-free.

The haul rope grip assembly and method of the present invention have other objects and features of advantages which will become apparent from and are set forth in more detail in the accompanying drawing and following description of the preferred embodiments.

B. Summary of the Invention

The detachable haul rope grip assembly of the present invention includes a gripping head having at least one movable jaw, jaw actuating assembly coupled to the jaw, and a load support structure coupled to the head. The improvement in the grip assembly comprise, briefly, the head being formed with a pair of relatively spaced apart convering haul rope gripping surfaces oriented for gravity biasing of the surfaces into wedging engagement with the haul rope under loading of the assembly, and the jaw being positioned proximate the surface and formed to apply a supplemental force to the haul rope in a direction tending to further wedge the haul rope between the gripping surfaces.

The permanent haul rope grip assembly is formed with wedge surfaces that are gravity biased toward the rope. A jaw preferably supplements the gravity induced gripping force to secure the grip to the rope against slippage with sufficient force to meet code requirements. Further, the wedge surfaces preferably are oriented to wedge the rope therebetween when the grip passes around a horizontal bull wheel.

The method of securing a grip to a haul rope of the present invention comprises, briefly, the steps of mounting wedge surfaces in the grip in an orientation producing a gravity induced gripping force, and urging the haul rope toward the wedge surfaces by a movable jaw to supplement the gravity induced gripping force. cl

DESCRIPTION OF THE PREFERRED EMBODIMENTS

Figure 1:
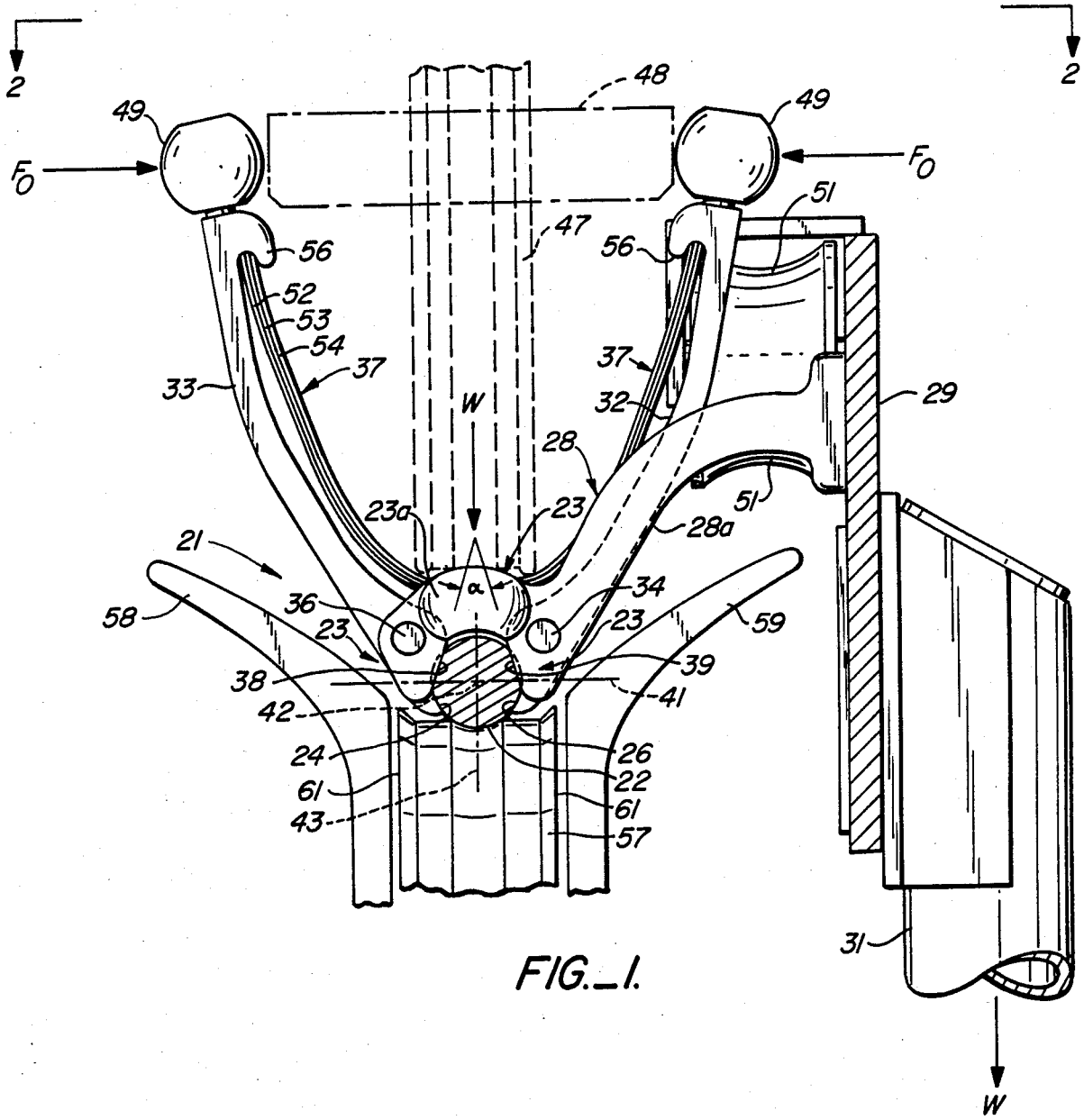
FIG. 1 is a fragmentary, end elevation view taken substantially along the plane of line 1—1 in FIG. 2 of a detachable grip assembly constructed in accordance with the present invention.
Figure 1A:
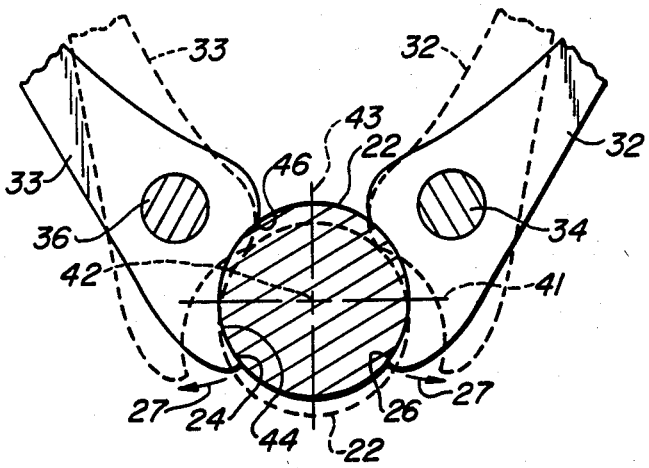
FIG. 1A is an enlarged, fragmentary front elevation view of a gripping jaw of the assembly of FIG. 1 with the head removed and a moved position shown in broken lines.
Figure 2:
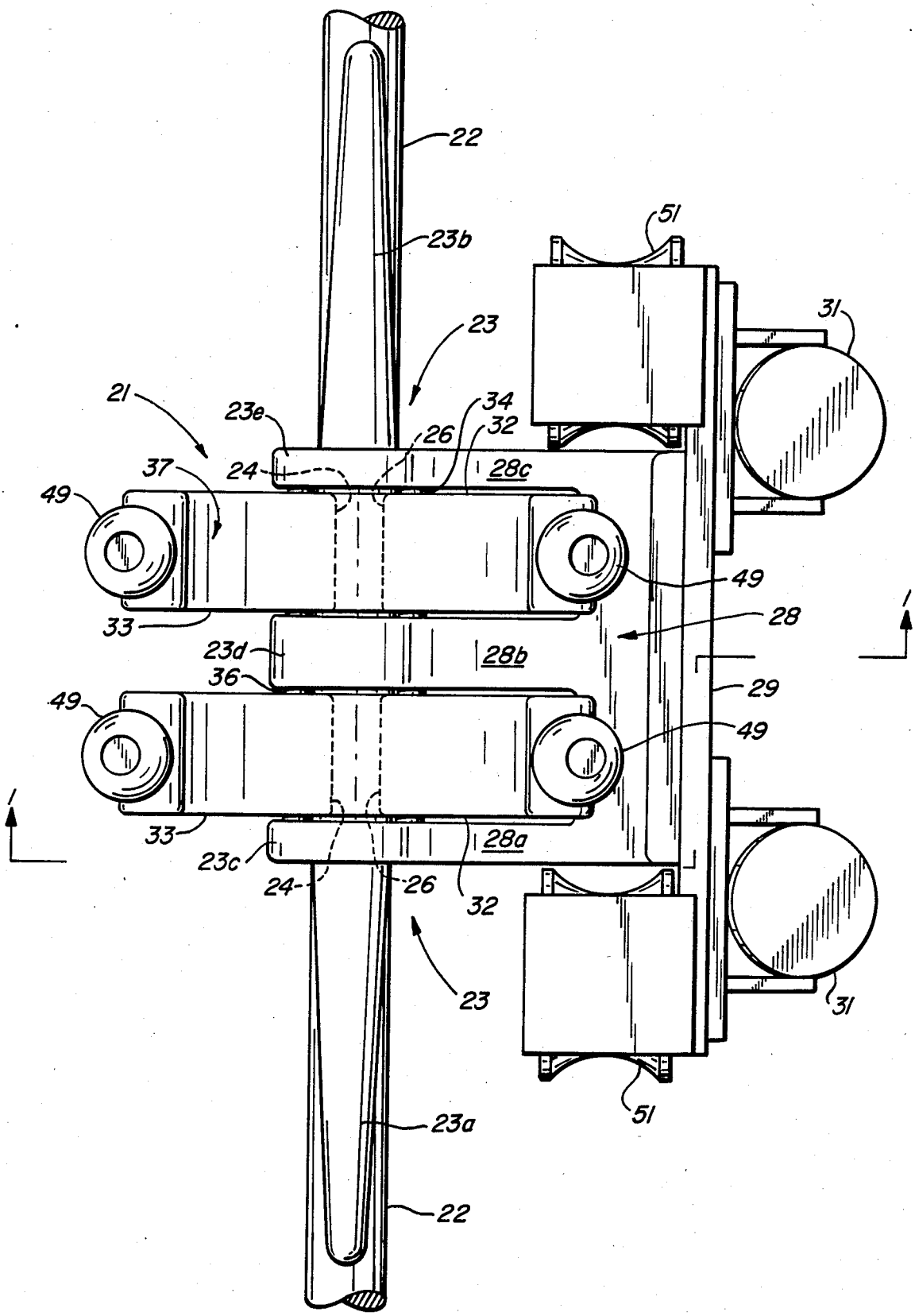
FIG. 2 is a top plan view of the grip assembly of FIG. 1.

The aerial tramway grip assembly and method of the present invention is suitable for use as a detachable or permanent haul rope grip assembly. FIGS. 1, 1A and 2 illustrate a detachable haul rope grip assembly, generally designated 21, that is used to grip an aerial tramway haul rope 22. Haul rope 22 is schematically illustrated and is usually comprised of a plurality of wires wrapped around a central core to form a cable or rope to which a plurality of passenger carrier units are affixed. For detachable aerial tramway units, such as condolas, grip assembly 21 is formed with a gripping head 23 which can be seen in FIG. 2 to extend longitudinally along the length of haul rope 22. Head 23 includes a nose portion **23*a* and a tail portion 23*b* which ride on the upper surface of rope 22 and have an inner arcuate surface which substantially conforms to the rope cross section. Intermediate the nose 23*a* and tail 23*b* of the head are three intermediate head portions 23*c*, 23*d* and 23*e*, which extend over the top of the rope and down along the sides to provide rope engaging surfaces 38 and 39 (FIG. 1**), as will be explained in greater detail hereinafter.

In order to prevent removal of rope 22 from head 23, and further in order to assist in generation of rope gripping forces, the rope assembly includes at least one jaw, and in this case two jaws 24 and 26, mounted for movement between an open position and a closed position. FIG. 1 and FIG. 1A show jaws in the closed position in solid lines. In the closed position, jaws 24 and 26 span around more than 180° of the cross sectional circumference of rope 22 so as to prevent removal of the rope from head 23. In the open position, shown in broken lines in FIG. 1A, the jaw 24 is moved, as indicated by arrow 27, until grip assembly 21 and rope 22 can be separated for detachment of the grip from the rope.

As will be seen in FIG. 2, assembly 21 actually includes two pairs of opposed jaws 24 and 26. As will be understood, however, it is possible to have a single pair of opposed jaws 24 and 26, and it is further possible within the scope of the present invention to have a single movable jaw, with one of jaws 24 and 26 being fixed.

Displacement of jaws 24 and 26 to enable opening and closing of the grip is accomplished by jaw actuating means here provided by pivotally mounted levers 32 and 33. As again may be seen in FIG. 2, there are actually two sets of opposed levers 32 and 33 which actuate the two sets of opposed jaws 24 and 26. Levers 32 and 33 are pivotally mounted to head 23 of the grip assembly by pivotal axles 34 and 36, and the levers are biased to the position shown in FIG. 1 by spring biasing means 37. Displacement of the levers 32 and 33 to move the jaws will be more fully described hereinafter.

Support of a passenger carrier unit or a load from grip assembly 21 is accomplished by an arm, generally designated 28, which can be seen from FIG. 2 to include three arm portions **28*a*, 28*b* and 28*c*. The arm portions 28*a*–28*c* are joined together at a common base to frame member 29, which in turn is secured to a pair of hanger arms 31 that extend downwardly to a passenger carrier unit cabin or the like (not shown). As will be understood, hanger arms 31 curve inwardly below rope 22 so that the weight, W, of the load is acting vertically down through grip assembly 21 substantially along a vertical plane 43 passing through the longitudinal axis 42** of the haul rope.

The grip assembly thus far described contains elements which are broadly known in grip assemblies currently in use in the industry. More particularly, it is broadly known to have detachable grip assemblies which include a head 23, a movable jaw 24, jaw actuating means 33, and load support means 28, and such a combination of elements per se is not regarded as being a novel portion of the grip assembly of the present invention.

The improvement in grip assembly 21 is comprised, broadly, of head 23 including relatively spaced apart, converging haul rope gripping surfaces 38 and 39 oriented for gravity biasing of the surfaces into wedging engagement with haul rope 22 under loading of support arm 28. Thus, surfaces 38 and 39 converge towards each other about vertical plane 43 at an included angle, $\alpha$, so that weight, W, acting downwardly through the grip automatically wedges the grip and surfaces 38 and 39 down over the haul rope. This orientation of wedging surfaces 38 and 39 automatically gravity induces a gripping force of the surfaces against the haul rope. Such wedging action produces substantial haul rope gripping forces without the need for any movable parts.

As the angle, $\alpha$, becomes smaller, the gravity induced gripping forces from wedging between surfaces 38 and 39 increases. More particularly, the gripping force generated between the wedging surfaces in the grip of FIG. 1 (the surfaces being inclined at equal angles $\alpha/2$ to vertical plane 43) is as follows:

$$F = W/(2 \sin \alpha/2)$$

When the included angle, $\alpha$, reaches about 14 degrees, the rope will become wedged between the surfaces in a manner which is self-locking, that is, a force must be used to push the rope away from the apex of the converging surfaces. Above about 14°, the smooth steel surfaces 38 and 39 will not normally become locked down upon the steel strand comprising the rope. Since assembly 21 is to be detachable, it is not normally desirable that the included angle be so small as to cause the assembly to be self-locking on the rope. Moreover, there is a plus 6% and minus 3% variation of the rope diameter, making it desirable in the detachable rope grip assembly of the present invention that surfaces 38 and 39 not converge at an angle less than about 14° or an angle which would make the grip self-locking.

At the other extreme, it is preferable that included angle, $\alpha$, not be greater than about 90°, and preferably in the range of about 14° to 60°. In a typical detachable grip constructed in accordance with the present invention, the included angle, $\alpha$, will be about 45°, with the weight of the passenger carrier being between 300 and 500 pounds. If the passenger carrier unit is loaded with four passengers having an average weight of 175 pounds, the total weight on the grip will be 1200 pounds, and the gravity induced gripping force, F, on each of the surfaces would be over 1500 pounds or a total of 3000 pounds of gripping force. Under most operating conditions, a 3000 pound gripping force would secure grip assembly 21 to haul rope 22 in a manner which would prevent slippage of the grip assembly along the haul rope. Thus, grip assembly 21 is essentially fail-safe, even if gripping jaws 24 and 26 should fail to operate, for example, as a result of failure of spring biasing means 37.

While the fail-safe grip assembly 21 is operable under virtually all conditions without gripping jaws, the addition of gripping jaws 24 and 26 further enhances safety and further enables the gripping assembly of the present invention to achieve the required safety factor for operating codes. In the grip assembly of the above example, jaws 24 and 26 add a total gripping force of about 2000 pounds. This supplemental gripping force acts below horizontal plane 41 and in an orientation opposed to surfaces 38 and 39 to further wedge rope 22 between the surfaces. This supplemental force is generated by spring means 37, which is preferably in the form of a plurality of layers of superimposed leaf springs 52, 53 and 54 which are bowed along the inside of lever arms 32 and 33 and held in place by flanges 56 at the upper ends of the levers. To the extent that a greater clamping force is required at jaws 24 and 26, additional layers of spring may be superimposed on each other and held by flanges 56.

An important feature of the grip assembly of the present invention is that the gravity induced gripping force need not be overcome in order to release the grip assembly from the haul rope. Thus, the opening force, $F_o$, required on cam followers 49 is multiplied by lever arms 32 and 33 and need only overcome the spring or clamping force in jaws 24 and 26, not the wedging force between surfaces 38 and 39. In the example above set forth, an opening force, $F_o$, of less than 500 pounds (e.g., 325 pounds) can be used to open the clamping jaws 24 and 26. This compares to a typical detachable grip opening force of as much as 5000 pounds in prior art assemblies. It should be noted that the bowed leaf spring assembly 37 has the advantage of acting in a substantially linear manner over the displacement between closed and open positions.

A further important advantage of the movable jaws of the grip assembly of the present invention can be understood by reference to FIG. 1A. As will be seen, it is preferable that the jaws 24 and 26 include an arcuate inner surface 44 that substantially conforms to rope 22 and terminates in a heel portion 46. As lever 33 is pivoted to the broken line position, heel 46 tends to drive rope 42 downwardly as it pivots about axle 36. This downward displacement insures that the rope will be forced out from between wedging surfaces 38 and 39. Even though the rope is not normally self-locked between the wedging surfaces as a result of the included angle, $\alpha$, being greater than will permit self-locking, variations in the coefficient of friction and the clamping force of jaws 24 and 26 adds to the wedging action and makes a positive downward displacement of the rope highly advantageous in insuring detachment of the assembly from the rope.

As is well known in the art, detachable grip assemblies and their passenger units are normally supported at tramway terminals by rolling elements, such as rollers 51, which roll on a terminal guide rail (not shown). Similarly, once the movable jaws are opened by cams (not shown) which engage the cam followers 49 at the terminal, the rope and support rail on which rollers 51 are rolling diverge so that the rope and grip are separated.

The grip assembly of the present invention has several other features which are highly advantageous. First, at the support towers intermediate the terminals, a guide 48 can be positioned so as to prevent inadvertent displacement of the cam followers inwardly in a manner which would release jaws 24 and 26. Any swinging of the grip and passenger carrier unit will be resisted by guide 48, and premature opening of the grip prevented. Additionally, the grip assembly is advantageously constructed in a manner which will permit a hold down sheave 47 to engage and roll along the top of grip head 23. Thus, at locations requiring hold down sheaves, sheave 47 can roll along the top surfaces of the head and levers 32 and 33, including bowed spring biasing assemblies 37, to maintain the necessary hold down force on the haul rope. Normally guide 48 and sheave 47 would not be present at the same tower, although both functions can be provided if desired by a combined structure (not shown).

Detachable grip assembly 21 is also well suited for use with a support sheave 57 having an inner rope catcher 58 and an outer catcher 59 that extends upwardly above the rims 61 of the sheaves and even above rope 22. Thus, the increased size of haul rope 22 allows gripping jaws 24 and 26 to grip the haul rope below plane 41 and yet extend upwardly proximate the sides of the haul rope sufficiently close to the haul rope as to permit the rope catcher flanges 58 and 59 to extend upwardly beyond the haul rope in relative close proximity thereto. As will be noted, the rope catcher flanges 58 and 59 will permit rocking of the assembly about longitudinal axis 42 of the haul rope by about 15 degrees.

Figure 3:
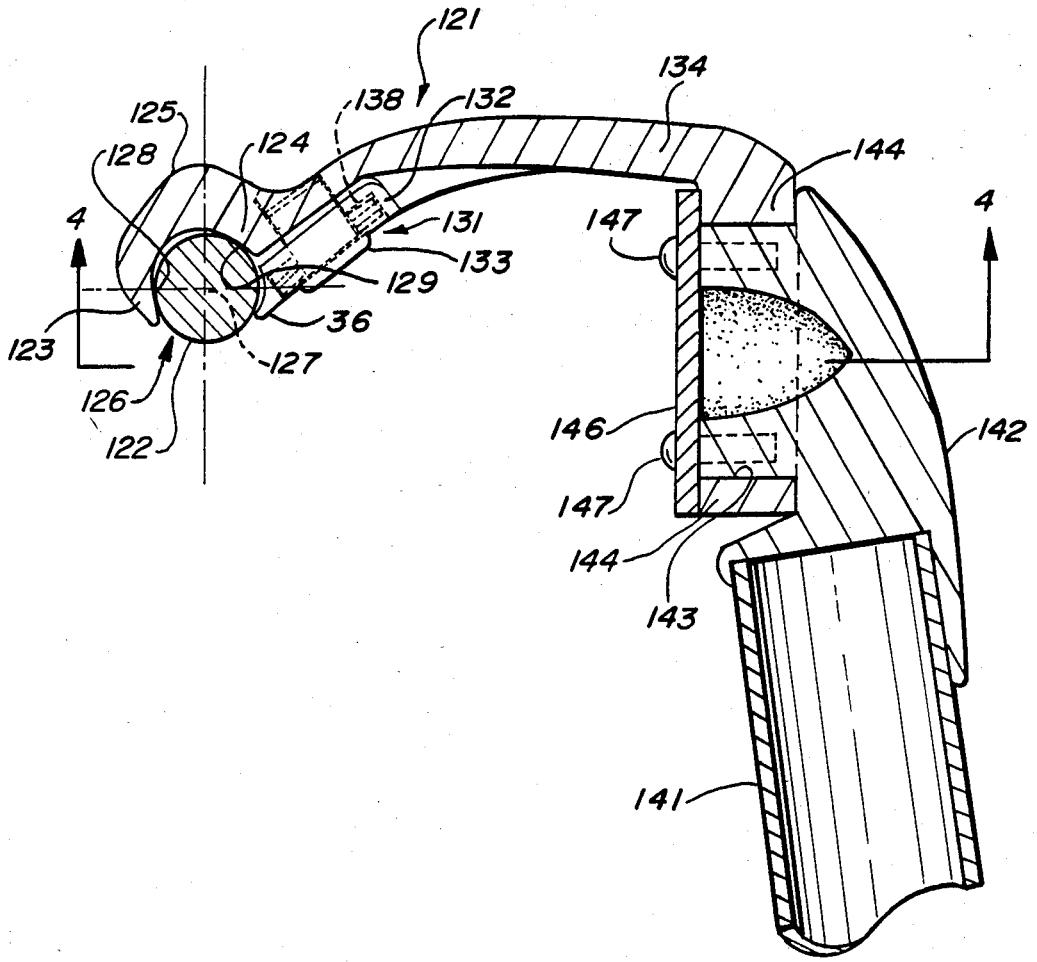
FIG. 3 is a fragmentary, front elevation view, in cross section of a permanent grip assembly constructed in accordance with the present invention.
Figure 4:
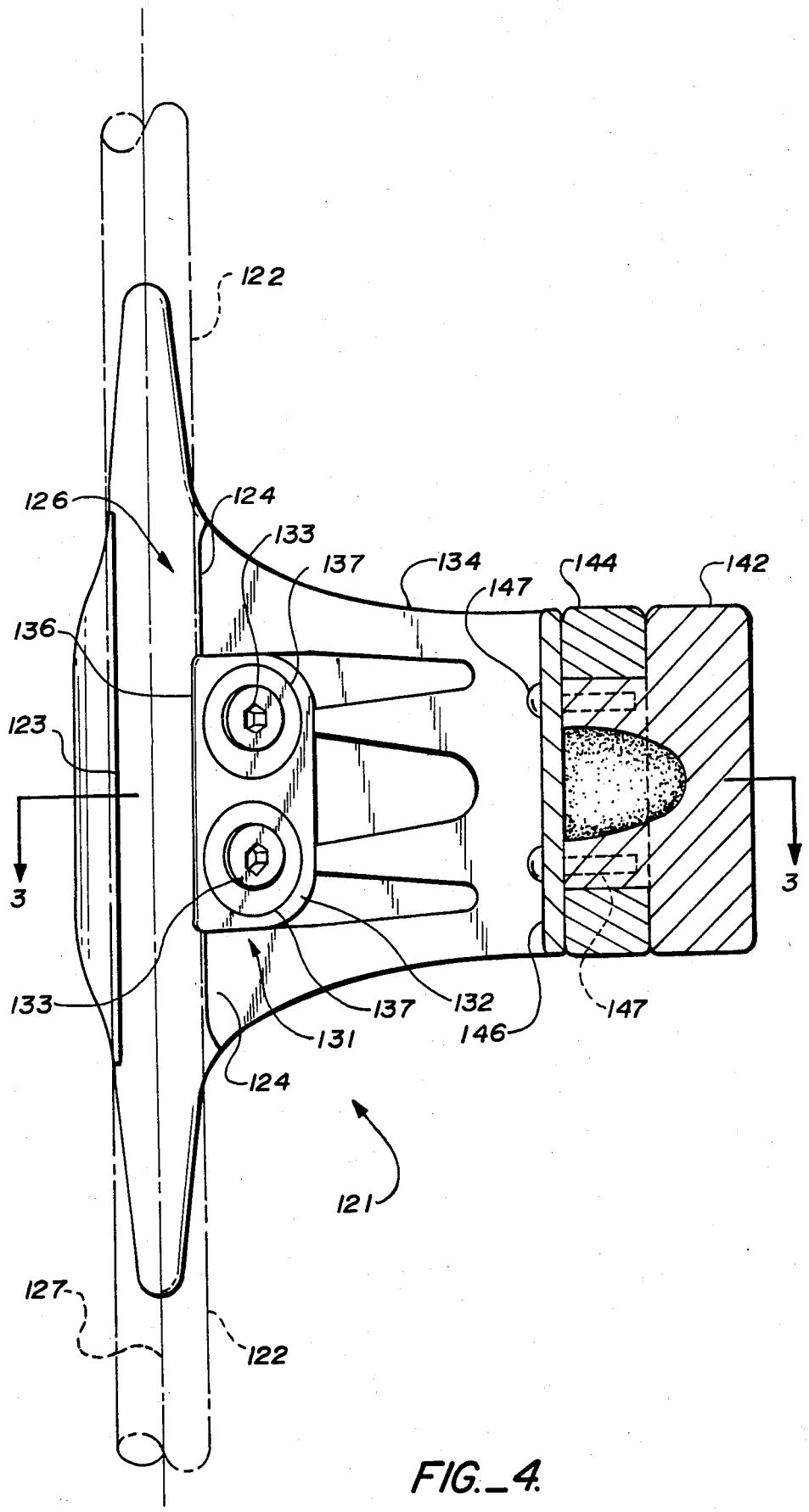
FIG. 4 is a bottom plan view in cross section taken substantially along the plane of line 4—4 in FIG. 3.
Figure 5:
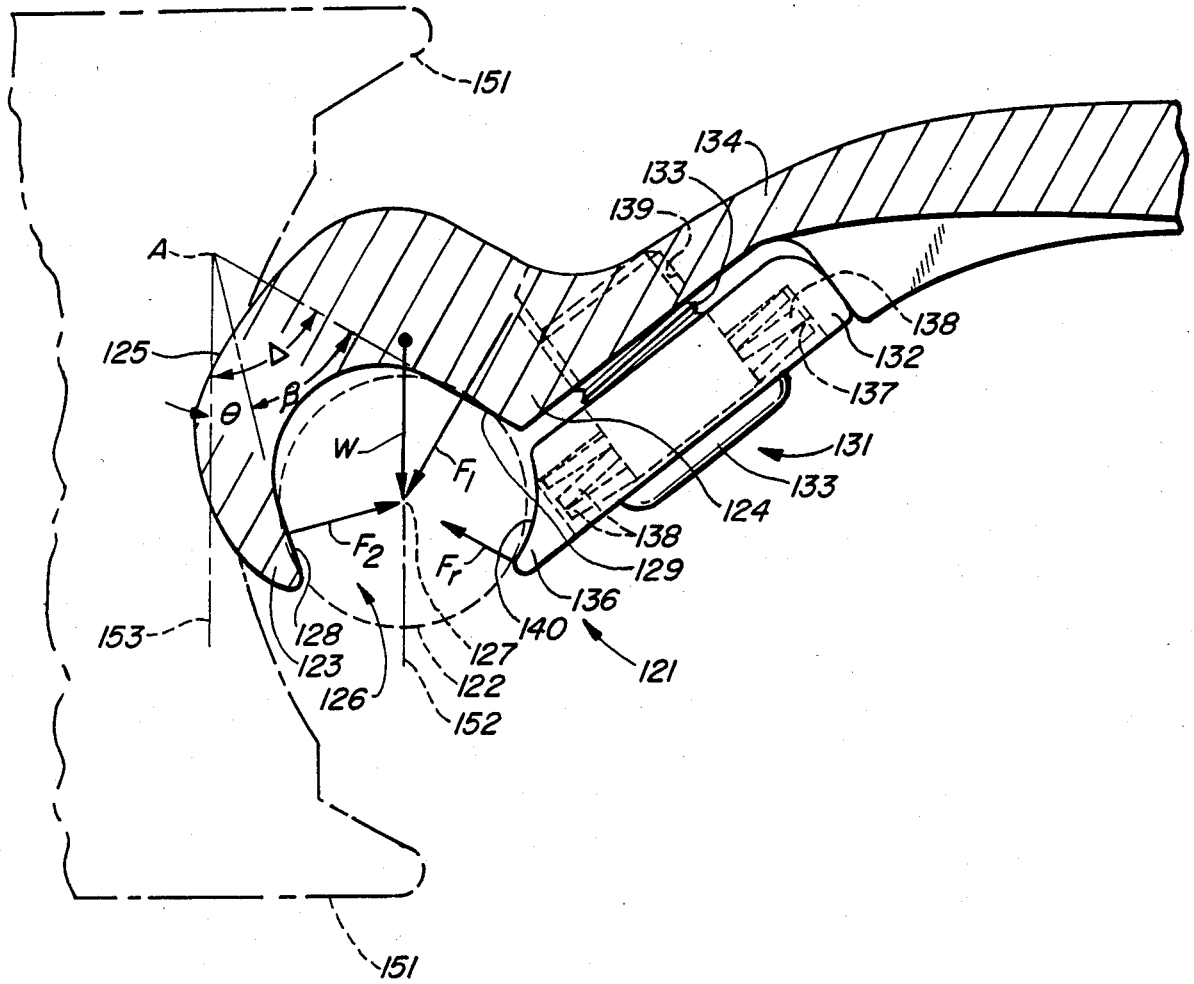
FIG. 5 is an enlarged, fragmentary, end elevation view, in cross section of the grip assembly of FIGS. 3 as it passes over a horizontal bull wheel, shown in phantom.

The provision of wedging surfaces oriented in a manner which will gravity bias the grip assembly to induce substantial gripping forces also can be applied to a "permanent" type of aerial tramway grip. Referring to FIGS. 3, 4 and 5, a grip assembly, generally designated 121, is shown which is designed to remain secured to haul rope 122 during normal operation of the tramway. Assembly 121 includes a head portion 125 having fixed, spaced apart jaws 123 and 124 defining a downwardly oriented mouth 126 inwardly of which are a pair of converging, spaced apart surfaces 128 and 129.

As best may be seen in FIG. 5, surfaces 128 and 129 are preferably relatively planar surfaces that converge along planes that intersect at apex A. Thus the wedging surfaces in gripping head 125 have an included angle therebetween of $\beta$. As haul rope 122 and grip assembly 121 are displaced toward each other so that axis 127 of the haul rope advances toward apex A, the wedging surfaces 128 and 129 progressively wedge down on the exterior of the haul rope to frictionally engage and grip the same.

It is further preferable that the permanent grip assemblies of FIGS. 3–5 include a rope retention means of movable jaw 131 mounted proximate mouth 126 and formed to maintain the haul rope in wedged condition between surfaces 128 and 129. The movable jaw 131 is here shown as a member 132 removably mounted by bolt 133 to grip arm 134. Extending outwardly at least partially across mouth 126 is a tip portion 136 of jaw member 132, and the jaw is preferably resiliently biased against haul rope 122 by biasing members 138 mounted in annular pocket 137 in member 132.

When threaded bolt 133 is cinched down in threaded bore 139, tip 136 applies a retention force, $F_r$, against rope 122 which adds to or supplements the gravity induced gripping force and drives rope 122 further toward apex A. This retention force, $F_r$, is applied to arcuate surface 140 and can be selected to have a magnitude which, when combined with the gravity induced force, will meet the required safety factor for aerial tramway grip assemblies.

It should be noted that even so called "permanent" grip assemblies must be able to travel or creep along the haul rope during usage so that dynamic stresses and shock loads are not repeatedly concentrated at a fixed location with resultant fatigue of the haul rope. The permanent grip 121, for example, may travel or creep 12 to 18 inches along rope 122 during the course of a year. For this reason, the surfaces 128, 129 and 140 typically are smooth so as to permit this creeping or travel of the grip assembly. Notwithstanding such creep, however, the assembly will have sufficient gripping forces therein to clamp the grip to the rope so as to prevent sliding along longitudinal axis 127 of the rope with a safety factor equal to three times the force required to start such slippage. It should be noted that Bellville springs 138 insure maintenance of supplemental gripping force, $F_r$, notwithstanding some dimensional variation of the haul rope along its length.

As best may be seen in FIG. 3, a typical permanent grip assembly will have an arm 134 which extends laterally from one side of haul rope 122. Mounted by mounting member 142 to arm 134 is a hanger arm 141, to which a chair, gondola or the like may be secured. Mounting member 142 passes through an opening 143 in a collar portion 144 of arm 134. Secured by fasteners 147 on the inward side of collar 144 is a mounting plate 146 which clamps the assembly together as a unit. It is preferable that a resilient material be placed between member 142 and collar 144 to damp vibrations and the like.

It is an additional important feature of the permanent grip assembly of FIGS. 3–5 that the assembly be constructed in a manner which supplements the gripping force as the grip moves around a horizontal bull wheel 151. Head 125 of grip 121 is preferably formed as a rigid body having a C-shaped transverse cross section. The wedging surfaces 128 and 129, however, are not oriented at equal angles about vertical plane 152 through the haul rope. Instead, surface 128 is oriented at an acute angle, $\theta$, on one side of vertical plane 153 passing through apex A which is parallel to and on one side of plane 152. Wedging surface 129 is oriented at a second angle, $\Delta$, on the same side of vertical plane 153. Second angle, $\Delta$, is equal to the sum of the angles $\theta$ and $\beta$, the included angle between two wedging surfaces.

As haul rope 122 passes around bull wheel 151, it tends to be pulled horizontally toward the center of the bull wheel. Thus, acute angle $\theta$ is preferably in the range of about 5° to about 25° so that the inward forces on the rope as it travels around the bull wheel will tend to wedge rope 122 toward apex A. The second angle $\Delta$ is preferably in the range of about 35° to 85° so that the included angle $\beta$ will be in the range of about 30° to 60°.

In the form of the grip shown in FIGS. 3–5, acute angle $\theta$ is 15° and $\Delta$ is 45°. This produces a gravity induced gripping force which is not evenly balanced, as was the case with the grip of FIGS. 1 and 2, but the gripping force on wedging surface 128, $F_2$, and surface 129, $F_1$ are sufficiently close in magnitude, that, when combined with gripping force induced by movable jaw 131, $F_r$, undue stress concentrations in the haul rope are avoided.

As will be seen from the description of the apparatus of the present invention, the method of securing the grip assembly to a haul rope for an aerial tramway of the present invention includes the steps of mounting grip assembly 21, 121 on haul rope 22, 122 with converging wedging surfaces 28, 29, 128, 129 oriented for gravity biased wedging down over the haul rope to generate a gravity induced gripping force proportional to the weight supported from the assembly, and urging the haul rope toward the wedging surfaces by jaw means 24, 26, 131 to generate a supplemental gripping force additive to the gravity induced gripping force. Additionally, in connection with detachable grip assemblies, such as assembly 21, the urging step is accomplished by resiliently pivoting jaws 24, 26 into engagement with the haul rope on a side of the haul rope opposite to the side against which surfaces 38, 39 are wedged. In a method of the present invention for permanent grip assemblies, the mounting step is further accomplished by orienting the gripping surfaces 128, 129 to generate a further supplemental gripping force when the grip assembly passes around a horizontal bull wheel 151.

The method and apparatus of the present invention enables use of the weight supported by the gripping assembly to create a substantial gravity induced gripping force. This gravity induced gripping force reduces the complexity required in the grip assembly in order to generate the substantial gripping forces required to maintain a significant safety factor, for example, a safety factor of three. Moreover, the use of wedging surfaces, particularly on a rigid fixed head, greatly reduces the number of components required for the grip and the number of moving parts. Still further, the method of the present invention enables detachment of detachable grips with opening forces which are an order of magnitude lower than the force which has typically been required in prior detachable grips. Finally, the grip assemblies of the present invention are fail-safe, and can actually be operated, but normally not with the desired safety factor, based upon the gravity induced wedging action alone. While it would be possible to construct a grip having sufficiently small included angle between wedging surfaces so as to lock the grip on the cable without the need for a movable jaw, such a construction is not preferred, and the increasing diameter of aerial tramway haul ropes makes it relatively easy to position a retainer jaw on a side of the haul rope opposite to the gripping wedges to apply a force which augments or supplements the gravity induced gripping forces.

What is claimed is:

1. In a detachable haul rope grip assembly for an aerial tramway, said assembly including a gripping head having a pair of gripping jaws each mounted for movement between an open position permitting mounting of said head over a haul rope and a closed position retaining said head in gripping engagement with said haul rope, jaw actuating means coupled to each of said jaws and formed for selective movement of said jaws between said open position and said closed position, and load support means coupled to said head and formed for support of a load to be conveyed from said grip assembly, the improvement in said grip assembly comprising:

said head including a pair of stationary relatively spaced apart converging haul rope gripping surfaces oriented for gravity biasing of said surfaces into wedging engagement with said haul rope under loading of said load support means, said gripping surfaces having one of said gripping surfaces oriented in opposed relation to one of said jaws in said closed position and a remainder of said gripping surfaces oriented in opposed relation to a remainder of said jaws in said closed position with each opposed jaw and gripping surface being formed and positioned to grip said haul rope therebetween and to secure said assembly to said haul rope independently of the other opposed jaw and gripping surface; and said jaws being positioned proximate said surfaces and formed to apply a supplemental force to said haul rope in said closed position in a direction tending to further wedge said haul rope between said surfaces.

2. The detachable haul rope grip assembly as defined in claim 1 wherein, said surfaces converge toward each other at an included angle greater than an angle which will produce self-locking of said haul rope between said surfaces.

3. The detachable haul rope grip assembly as defined in claim 1 wherein, said jaws are each positioned proximate and opposed to one of said surfaces with each opposed set of said surfaces and said jaws engaging said haul rope circumferentially around more than 180° of the circumference of said haul rope.

4. The detachable haul rope grip assembly as defined in claim 1 wherein, said jaws are pivotally mounted to said head, and said jaws are formed to engage said haul rope and urge said haul rope in a direction unwedging said haul rope from between said surfaces upon movement of said jaws from said closed position to said open position.

5. The detachable haul rope grip assembly as defined in claim 1 wherein, said jaw actuating means includes layer means coupled to move said jaws upon displacement of said lever means; and said lever means is provided by a pair of levers extending away from said head in spaced apart relation to define a space therebetween dimensioned to receive a hold down sheave.

6. The detachable haul rope grip assembly as defined in claim 1 wherein, said jaw actuating means includes a pair of opposed levers coupled to move said jaws upon displacement of said levers; and a leaf spring mounted between said levers in a partially bowed condition to bias said levers in a direction maintaining said jaws in said closed position.

7. A haul rope grip assembly for an aerial tramway, said assembly including a head having a pair of opposed surfaces mounted in spaced apart and relatively inclined relation to each other and formed to engage and wedge a haul rope therebetween, and load support means coupled to said head and formed for support of a weight therefrom, wherein the improvement in said grip assembly comprises:

said surfaces being formed in said head for mounting on said haul rope in an orientation gravity biasing of said surfaces toward said haul rope in a direction wedging said haul rope between said surfaces with sufficient force to secure said grip assembly to said haul rope against movement along said haul rope upon loading of said support means;

movable jaw means mounted to said head in juxtaposed relation to each of said surfaces to provide two sets of a gripping surface and juxtaposed jaw means each independently securing said assembly to said haul rope, said jaw means further applying a supplemental force to said haul rope in a direction wedging said haul rope between said surfaces; said jaw means are actuated by movement of attached lever means; and said lever means is provided by a pair of levers extending away from said head in spaced apart relation to define a space therebetween dimensioned to receive a hold down sheave.

* * * * *